US005582359A

United States Patent [19]

Wicha

[11] Patent Number: 5,582,359

[45] Date of Patent: Dec. 10, 1996

[54] PAPER WEB CUTTING DEVICE

[75] Inventor: Lothar J. Wicha, Karlstadt, Germany

[73] Assignee: Koenig & Bauer Aktiengesellschaft, Wurzburg, Germany

[21] Appl. No.: 504,419

[22] Filed: Jul. 20, 1995

[30] Foreign Application Priority Data

Jul. 20, 1994 [DE] Germany ..... 44 25 662.0

[51] Int. Cl.[6] ..... B65H 18/10; B65H 19/22; B41F 13/03

[52] U.S. Cl. ..... 242/527; 242/527.3; 242/532.6; 242/532.7; 242/562.1; 101/227

[58] Field of Search ..... 242/527, 527.1, 242/527.2, 527.3, 521, 532.6, 532.7, 562.1, 587.2; 226/92; 101/224, 226, 227

[56] References Cited

U.S. PATENT DOCUMENTS

| | | | |
|---|---|---|---|
| 2,528,713 | 11/1950 | Thomson . | |
| 2,973,157 | 2/1961 | Korsch et al. | 242/532.6 |
| 4,550,881 | 11/1985 | Boardman | 242/527 |
| 4,844,369 | 7/1989 | Kanayachi | 242/527 |
| 5,067,402 | 11/1991 | Marx | 101/226 |
| 5,152,471 | 10/1992 | Goerner | 242/532.7 |
| 5,263,414 | 11/1993 | Lehrrieder | 101/228 |

FOREIGN PATENT DOCUMENTS

| | | |
|---|---|---|
| 2210140 | 6/1974 | France . |
| 3142089 | 7/1982 | Germany . |
| 3437455 | 4/1986 | Germany . |
| 4030600 | 7/1992 | Germany . |
| 4202713 | 11/1993 | Germany . |
| 2263437 | 7/1993 | United Kingdom . |

*Primary Examiner*—John M. Jillions
*Attorney, Agent, or Firm*—Jones, Tullar & Cooper, P.C.

[57] ABSTRACT

A paper web cutting device utilizes a slit shaft that is positioned adjacent pair of cooperating cylinders and which has a slit through which a paper web passes. The shaft is rotatable to transversely sever the paper web which is then rolled on the slit shaft. The shaft can be displaced away from the printing couple in a direction opposite to the direction of web travel as the paper web builds up on the shaft. The accumulation of the web on the slit shaft prevents bunching of the web or the roll-up of the web on the printing cylinders.

14 Claims, 5 Drawing Sheets

PAPER WEB CUTTING DEVICE

FIELD OF THE INVENTION

The present invention is directed generally to a device for cutting a paper web. More particularly, the present invention is directed to a device for the transverse cutting of a paper web. Most specifically, the present invention is directed to a device for accomplishing the transverse cutting of a paper web for the purpose of preventing damage to a web-fed rotary printing press. A shaft assembly is shiftably supported between side frames of the printing press generally at the inlet between two cooperating cylinders. This shaft assembly includes a rotatable shaft having an axially extending slit through which the paper web is fed. If the web must be cut because of a downstream press emerging or malfunction, the slit shaft will be caused to rotate to thus cut the web. The leading end of the now severed web is wound onto the slit shaft which is shifted away from the inlet area of the two cylinders by the accumulating paper web build up.

DESCRIPTION OF THE PRIOR ART

Web-fed rotary printing press assemblies typically utilize cutting cylinders and cooperating counter cutting cylinders to form repetitive transverse cuts in a printed web. These transverse cutters are used to separate an endless printed web into a plurality of discrete printed sheets. A large variety of these transverse paper web cutters are known in the art.

In the operation of a web-fed rotary printing press, the need sometimes arises to sever the paper web at a location in the press other than at the transverse cutting cylinders. The paper web may become torn or may be otherwise damaged or become defective. It may then become necessary to cut the paper web at a point remote from the conventional cutters in order to avoid further press or web damage. In order to accomplish this emergency web cutting, it is known generally in the art to provide emergency actuated paper web cutters.

One paper web cutting device is depicted in German Published Non-Examined Patent Application DE-0S-31 42 089. In this device, a paper web is fed, in a contactless manner, through a transverse slit in a shaft that is rotatably supported. The cutting edge of a stationary cutting blade is positioned adjacent the surface of the slit shaft. The rotatable shaft is connected to a control assembly which, in response to a signal from a suitable sensor, will allow the slit shaft to be rotated through 90° by a prestressed torsion spring. As the slit opening in the shaft moves by the stationary cutter blade, the paper web will be severed. The rotation of the slit shaft also blocks the path of paper web travel to the next processing station in the web-fed press. The newly created leading edge of the web is fed out laterally between two pairs of rollers.

One limitation of this prior art device is that the removal of the cut-off paper web can cause bunching up of the web or mis-direction of the web between the pairs of rollers. The spacing of these roller pairs is very sensitive and can be adversely affected if a large mass of bunched up paper web should inadvertently pass between these rollers. Once the web has been severed by the prior art transverse cutting device, it has no easy disposal path.

This prior art device also relies on the cooperation of a stationary cutting blade with the slit shaft to accomplish severing of the paper web. The positioning of a sharp cutter blade in the paper web travel path may pose a serious safety hazard since press operators are frequently required to work in this area.

A further limitation of this prior art device is its incompatibility with the typical web leading end feeding or drawing-in elements that are used to feed the web through the press prior to press start-up. These web draw-in elements typically have a finite length and may be, for example, a roller chain that has a separate drive means at each press station. The use of a rotary slit shaft, such as the one disclosed in this prior art device, cannot be used with a web leading end draw-in device. Thus additional time is required, after a web break has occurred, to feed the web back through the printing press.

It will be seen that a need exists for a device to accomplish the transverse cutting of a paper web which overcomes the limitations of these prior art devices. The paper web cutting device in accordance with the present invention provides such a device and is a significant improvement over the prior art.

SUMMARY OF THE INVENTION

It is an object of the present invention to provide a paper web cutting device.

Another object of the present invention is to provide a device for the transverse cutting of a paper web.

A further object of the present invention is to provide a paper web cutting device for transversely cutting a paper web in a rotary printing press.

Yet another object of the present invention is to provide a paper web cutting device which will remove the cut paper web from the area of the inlet of two cooperating cylinders.

Still a further object of the present invention is to provide a paper web cutting device which will wind up the leading end of the newly cut paper web.

Even yet an additional object of the present invention is to provide a paper web cutting device that will operate with a paper web drawing-in assembly.

As will be discussed in greater detail in the description of the preferred embodiment which is presented subsequently, the paper web cutting device in accordance with the present invention utilizes an axially slit, rotatable shaft through which the web is fed. The leading edge of the slit in this shaft is roughened to cut or break the web when the shaft is rotated in response to a control signal. This slit shaft is part of a shaft assembly that is slidably supported in the inlet wedge between two cooperating cylinders by slidable bearing support units. As the slit shaft is rotated to cut the web, it also functions as a spindle about which the newly created leading end of the web begins the wrap. The slit shaft or spindle increases in effective diameter due to the build up of paper on it. As the diameter of the spindle and web increases, the periphery of the building web contacts one of the cylinders in the cylinder pair. This contacted cylinder has a complimentary direction of rotation so that the enlarging slit spindle and wound up web will move away from this cylinder without causing any damage to either.

Since the paper web cutting device of the present invention does not use a fixed sharp cutting blade to cooperate with the slit cylinder in the severing of the paper web, there is no exposed cutting blade that can cause injury to a press operator. The slit cylinder can be placed very close to the point of contact between the two cooperating printing cylinders due to its slidable support arrangement. This again promotes press operator safety since the operator will not typically be apt to have his hands in this area. Thus additional finger protection devices, that were required in connection with the prior art devices, can be omitted from the present invention.

Only short roll-ups can occur because of the disposition of the cutting device near the printing cylinder. In addition, the cut paper web is completely removed and will not be able to cause problems and will not be able to bunch up or go through the printing cylinders in a bunch or a wad before the press can be stopped. The newly created paper web leading end will wrap about the rotatable slit shaft and will start to accumulate on the slit shaft. As the effective diameter of the shaft and the accumulating web increases, the shaft will be slidably moved away from the cooperating cylinders. The slit shaft is supported by slidable bearings with its axis of rotation closer to one of the cylinders in the printing couple or pair. The slit shaft's axis of rotation is offset so that it is closer to the one cylinder of the printing couple that is rotating in the complimentary direction. As the web builds up on the slit shaft prior to press shut-down, the outer surface of the web will engage the adjacent printing cylinder. This will shift the axis of rotation of the slit shaft away from this printing cylinder in response to web build-up on the slit shaft or spindle. Thus a variable length of the still unprinted, cut-off paper web can build up on the slit spindle. This will occur automatically as a function of web length and paper web thickness. The built up, unprinted cut-off paper web can be removed from the slit spindle once the press has been stopped.

Once the press has been stopped and the built up paper web has been removed from the slit spindle, the spindle will return to its original location. The driven roller chain of a known paper web draw-in device can be used to feed a fresh paper web into the printing couple and through the press. The draw-in device is fed through a guide that is supported adjacent the slit spindle. As the effective diameter of the slit spindle increases, due to web build up, the profiled strip that acts as a guide for the roller chain can be shifted out of the way. As soon as the built-up web has been removed from the slit shaft, the profiled strip can be returned to its original position so that it will act as a guide for the web leading end infeed chain. Thus the printing press can return to normal operation in a minimal amount of time.

The paper web cutting device in accordance with the present invention overcomes the limitations of the prior art devices. It is a substantial advance in the art.

BRIEF DESCRIPTION OF THE DRAWINGS

While the novel features of the paper web cutting device in accordance with the present invention will be set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
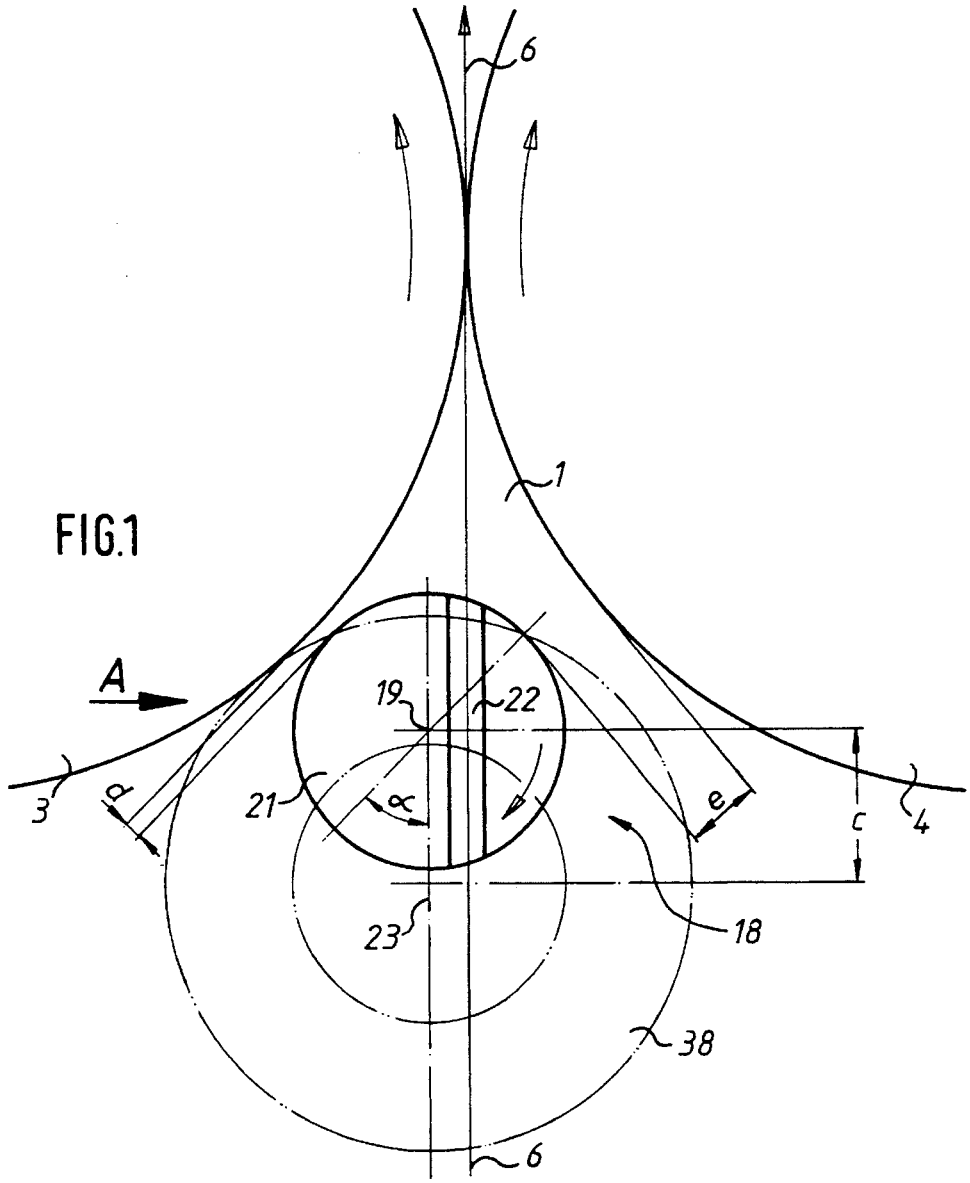
FIG. 1 is a schematic cross-sectional view through a portion of a printing couple, taken along line I—I of FIG. 3, and showing the slit shaft of the present invention and with the side frames of the press and the bearing assembly of the slit shaft removed for clarity.

Referring initially to FIG. 1, there may be seen a schematic depiction of a pair of cooperating cylinders 3 and 4, which may be printing cylinders in a web-fed rotary printing press of generally conventional construction and operation. These two cooperating cylinders 3 and 4 have an inlet wedge area 1. As is depicted in a somewhat schematic manner, a shaft assembly, generally at 18, and which may be seen more completely in FIG. 3 and which will be discussed in detail shortly, is positioned generally in the inlet wedge 1 between the printing cylinders 3 and 4. This shaft assembly 18 includes a slit shaft 21 having a transverse, axially extending slit 22. A paper web 6 being printed by the printing cylinders 3 and 4 passes through the slit 22 in slit cylinder 21 during normal press operation.

Figure 3:
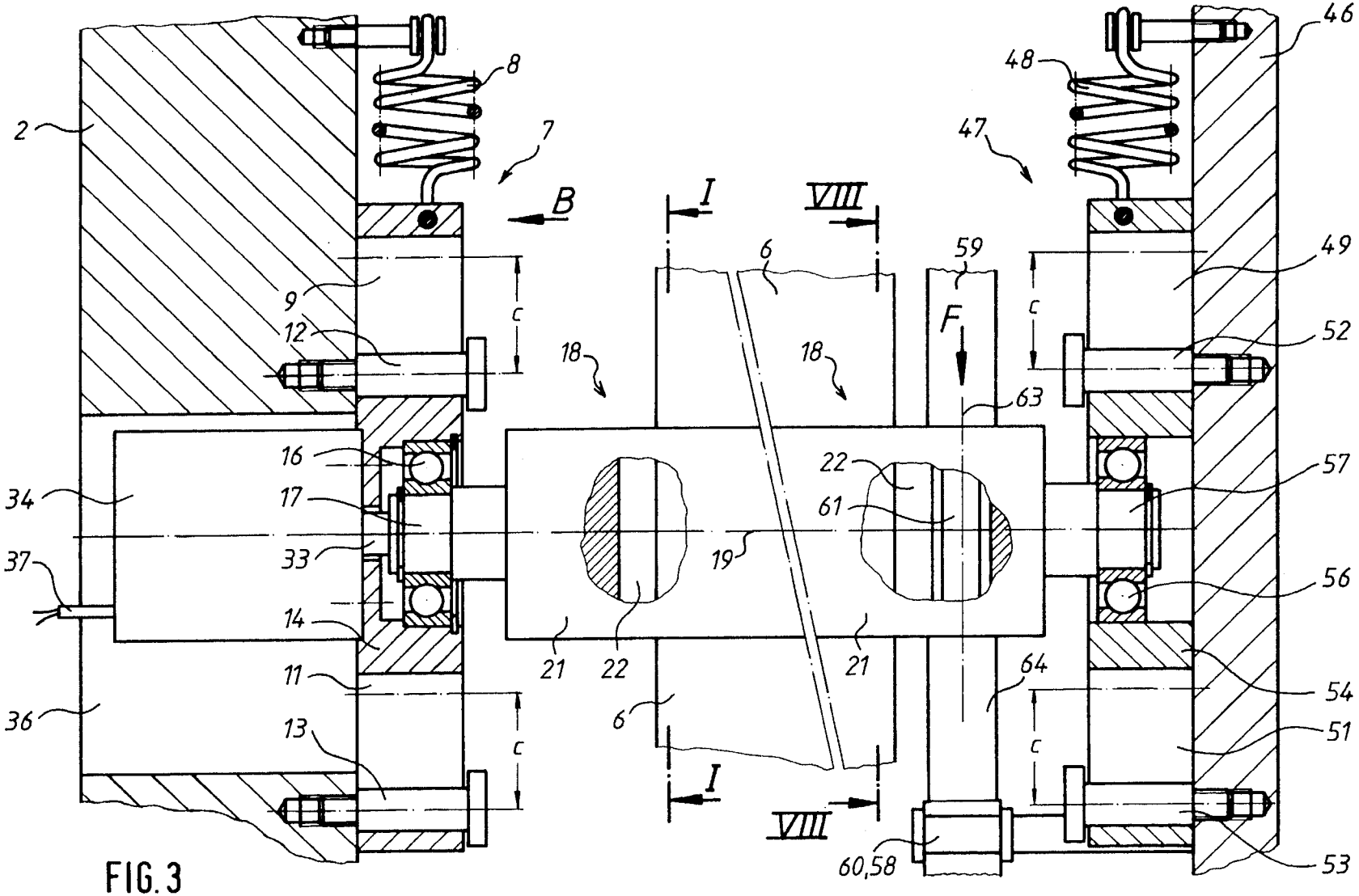
FIG. 3 is a top plan view of the paper web cutting device of the present invention, partially in section with the device in its rest position and with the cylinders of the printing couple removed for clarity.

Turning now to FIG. 3 in conjunction with FIG. 1, the shaft assembly 18 includes first and second slidable bearing support units 7 and 47 which are used to support the slit shaft 21 for movement generally vertically between spaced side frames 2 and 46 of the printing press through an amount "c". Each of the bearing units 7 and 47 includes a flange or bearing support plate 14 and 54, respectively, which is slidably supported against an inner surface of its respective side frame 2 or 46. Suitable springs 8 and 48 are attached to the bearing support plates 14 and 54 and bias the shaft assembly 18 to its rest position in the inlet wedge 1, as depicted by solid lines in FIG. 1.

The flange or bearing support plate 14 has upper and lower elongated slots 9 and 11, as seen in FIG. 3. The flange or bearing support plate 54 is provided with similar elongated slots 49, and 54, as also shown in FIG. 3. Each of these slots engages a shank of an elongated bolt 12, 13, 52 or 53 respectively, that is provided with an enlarged head and which is received in the associated side frame 2 or 46. These elongated bolts guide their respective bearing support plates 14 and 54 for movement along the inner surfaces of the side frames 2 and 46 toward and away from the printing cylinders 3 and 4.

Each of the flanges or bearing support plates 14 and 15 carries a suitable bearing 16 or 56, respectively. Each of these bearings 16 and 56 may be a deep groove ball bearing assembly and each receives an end journal 17 or 57, respectively of the slit shaft 21. The slit shaft 21 is thus supported in the flanges or bearing support plates 14 and 54 for rotation about its center of rotation 19 and for translation toward and away from the printing cylinders 3 and 4 in the inlet wedge area 1.

Again referring to FIG. 1, it may be seen that the slit shaft 21 has an axially extending, transverse slit 22 which is at least as wide as the maximum width of a paper web 6 that may be handled by the printing cylinders 3 and 4. This width 22 is shown in FIG. 3. The slit shaft 21 may have a circular cross-section. The elongated slit 22 may be aligned with the diameter of the shaft 21. Alternatively, as depicted in FIG. 3, the slit 22 may be offset from the axis of rotation 19 of the shaft 21 so that it does not touch this axis of rotation.

As is also seen in FIG. 1, the paper web 6 passing between the printing cylinders 3 and 4 forms a vertical center line that extends through the inlet wedge 1 and between the cylinders 3 and 4. The axis of rotation 19 of the slit shaft 21 is movable along a vertical centerline 23 that is offset to one side of the printing couple vertical centerline as defined by the paper web 6. The reason for this will be discussed shortly. It is important that the slit shaft 21 be situated in its rest position as depicted in FIG. 1 in which the paper web 6 passes freely and without contact through the slit 22 in the slit shaft 21.

Figure 2:
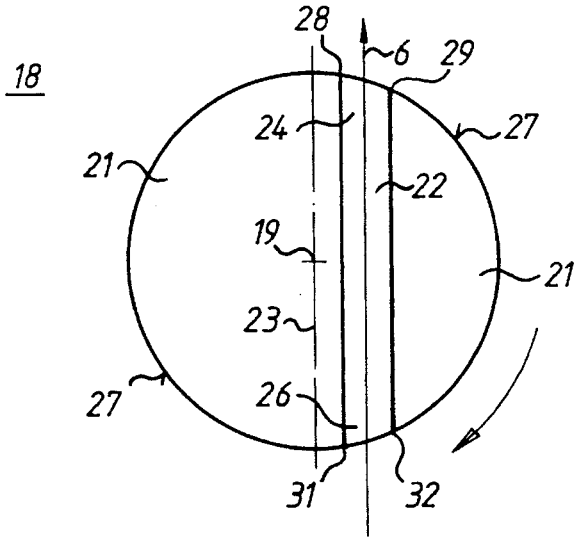
FIG. 2 is a top plan view of the slit shaft of FIG. 1.

Turning to FIG. 2 which shows the slit shaft 21 in detail, the ends 24 and 26 of the slit 22 have rounded frontal edges 28, 29 and 31, 32 respectively where the slit ends 24 and 26 meet the peripheral surface 27 of the shaft 21. At least one of these four edges, which in this embodiment is the trailing edge 28, will have a roughened or otherwise modified surface that will engage the paper web 6 upon rotation of the slit shaft 21 in the clockwise direction, as indicated by the arrow on the shaft 21 in FIG. 1. This surface roughening will create a paper web cutting aid, an alternate embodiment of which is depicted at 30 in FIG. 7. This paper web cutting aid 30 may have a rough or a roughened surface of high frictional resistance and can be made of tungsten carbide or the like. Alternatively, this paper web cutting aid 30 could be in the form of protrusions and depressions in the metal shaft 21 at the edge 28, such as could be formed by a file cut. A serrated cutter strip could also be attached to edge 28 to form the paper web cutting aid 30. As the slit shaft 21 is rotated in a clockwise manner, the first trailing edge 28 to contact the paper web 6 will cut or sever the web 6. Continuing rotation of the slit shaft 21 in the clockwise direction will start the build up of the leading end of the newly cut web 6 on the slit shaft 21.

As may be seen in FIG. 3, a gear motor 34 is secured to the first flange or bearing support plate 14 and engages the left journal 17 of the slit shaft 21 of shaft assembly 18 through a coupling 33. This gear motor 34 is positioned in a cut-out or aperture 36 in the side frame 2 and will move vertically with the slit shaft 21. The gear motor 34 is connected by a suitable line 37 with a paper web tear signal device that is not specifically shown in the drawings. This line also provides suitable electric power to the gear motor 34. Upon the sensing of a paper web break or tear, the sensor will provide a signal to the gear motor 34 through the line 37. This will actuate the gear motor 34 to turn the slit shaft 21 in the clockwise direction, as indicated in FIG. 1. Rotation of the slit shaft 21 in this manner will bring the first trailing edge 28, which has been treated or otherwise provides paper web cutting aid 30, into contact with paper web 6. This results in severing of the web 6. The slit shaft 21 is continued to be turned in the clockwise direction by gear motor 34. The newly created leading end of the paper web 6 will thus start to wind up and to build up on the slit shaft 21 which now acts as a winding spindle. The paper web 6 will continue to build up on the slit shaft 21 of the shaft assembly 18 until the press can be turned off and the paper web feed to the printing cylinders 3 and 4 terminated. Turning off of the press is accomplished concurrently with actuation of the gear motor 34 but cannot be accomplished instantaneously.

As the newly created leading end of the paper web 6 is wound on the slit shaft 21 or spindle, the effective direction of spindle 21 will increase. This will require that the shaft 21 shift away from its initial position, depicted in solid lines in FIG. 1, closely adjacent cylinder 3. The shaft 21 will shift along its vertical center line 23 to the position depicted in dot dash lines in FIG. 1 by the time that the paper web feed can be stopped. This travel distance is indicated at "c" in FIG. 1. The accumulated paper web that has been wound on shaft 21, and that is responsible for the increase in the effective diameter of shaft 21 is indicated at 38 in FIG. 1. The shifting of shaft 21 in the diameter away from the printing cylinders 3 and 4, which is in the direction opposite to the production movement direction of the paper web 6, is facilitated by the sliding movement of the bearing support plates 14 and 54 along their respective side frames 2 and 46. The direction of travel of bearing support plates 14 and 54 is constrained by the interaction of the support plate slots 9, 11, 49 and 51 and their cooperating bolts 12, 13, 52 and 53.

It will be recalled that the axis of rotation 19 of the slit shaft 21 is situated on vertical centerline 23 which is offset to the left of the path of travel of the paper web 6 through the inlet wedge 1 of the cylinders 3 and 4. This means that a first spacing distance "d" between the periphery 27 of the slit shaft 21 and the periphery of the first cylinder 3 is less than a second spacing distance "e" between the periphery 27 of the slit shaft 21 and the periphery of the second cylinder 4. It will also be seen that the rotational directions of slit shaft 21 and cylinder 3 are complimentary; i.e. one is clockwise while the other is counterclockwise. The result is that as the effective size of the slit shaft 21 increases due to a build-up of the paper web 6 wound on it, the surface of the built-up paper 38 will engage the surface of the first printing cylinder 3. Since the shaft 21 and the cylinder 3 have complimentary directions of rotation, they will roll off each other. As the paper web accumulation 38 increases on slit shaft 21, this roll-off of shaft 21 on cylinder 3 will displace slit cylinder 21 downwardly through the distance "c". This downward displacement of slit shaft 21 to the position indicated by dot-dash lines in FIG. 1 is accomplished against the spring force provided by springs 8 and 48 acting on the bearing support plates 14 and 54. It would also be possible to utilize a working cylinder or a toothed rack and an associated driven pinion gear in place of spring 8 as the adjustment means.

Figure 4:
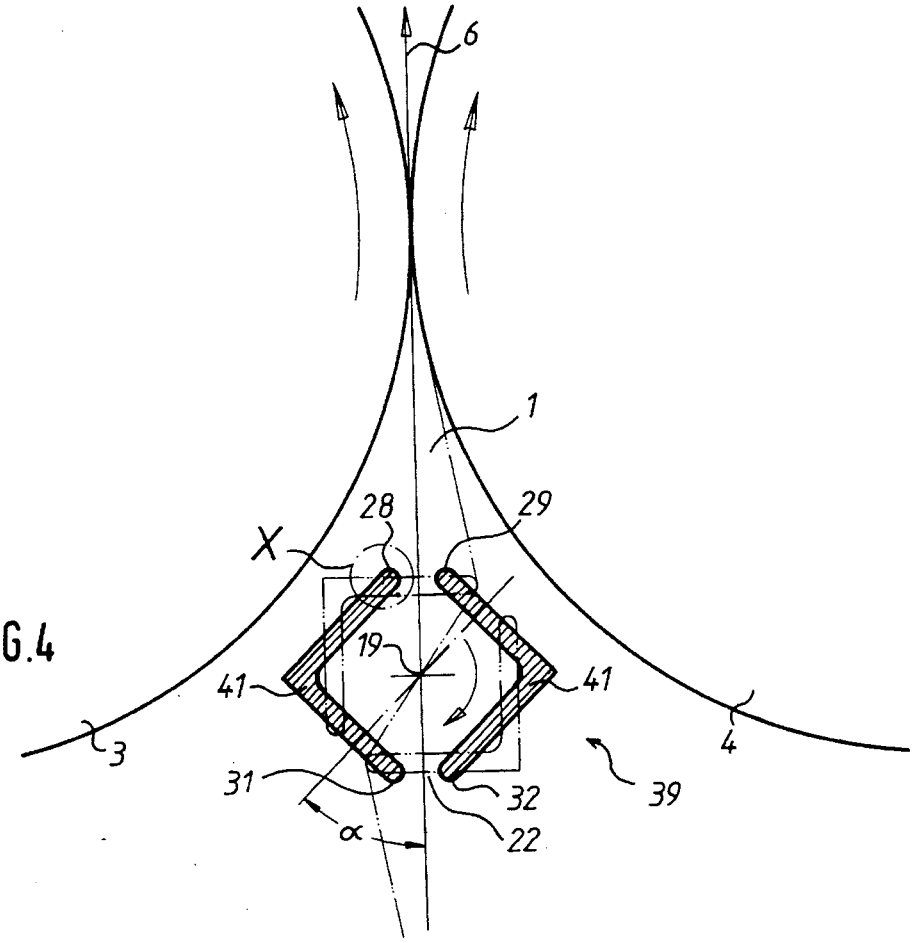
FIG. 4 is a view similar to FIG. 1 and showing an alternate structure for the slit shaft.
Figure 5:
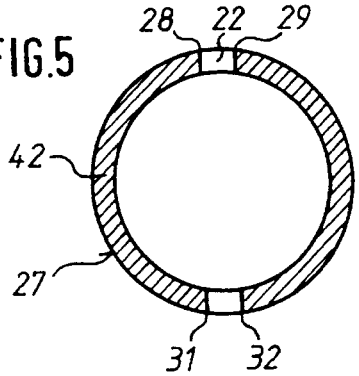
FIG. 5 is a view similar to FIG. 2 and showing another embodiment of a slit shaft.
Figure 6:
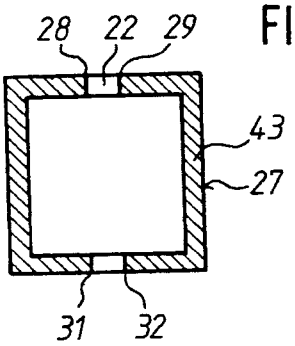
FIG. 6 is a view similar to FIGS. 2 and 5 and showing a further embodiment of a slit shaft in accordance with the present invention.
Figure 7:
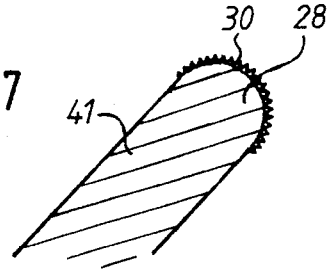
FIG. 7 is an enlarged view of a portion of the slit shaft a encircled at X in FIG. 5.

The slit shaft 21 which is depicted in FIGS. 1–3 is a solid shaft 21 having a transverse, offset, axially extending slit 22. Several other shaft structures that are also usable in the present invention are depicted in FIGS. 4–6. As may be seen in FIG. 4, the slit shaft, identified generally at 39, can be a tube which is generally square in cross section, as seen at 41 in FIG. 4, and which is provided with diagonally opposing edges 28, 29, 31 and 32. Alternatively, the shaft 39 can be a slit tube 42 with diametrically opposed edges 28, 29, 31 and 32, as seen in FIG. 5. In another alternative, the shaft 39 can be a hollow square profile tube 43 which is provided with edges 29, 30, 31 and 32 that define openings on two opposing sides. Alternatively, these tubes 41, 42 and 43 could be solid. In each instance, at least the edge 28 of the shaft 39 is provided with the paper web cutting aid 30, as previously described. This paper edge cutting aid 30, as depicted in FIG. 7, is associated with an edge 28 of the opening in the diagonally slit tube 41 of FIG. 4. The profiles 41, 42 and 43 can be slit "centered", as they are shown, or could be slit "off-centered" as the slit 22 in shaft 21 is situated. The shaft 39 is depicted in solid lines in its rest position, and is depicted in dot-dash lines in its paper web severing position where it has been rotated clockwise by an angle α of at least 45° . The same angle of rotation between rest and paper web severing positions is shown in FIG. 1 in connection with the slit shaft 21.

In the operation of a web-fed rotary printing press, as was discussed previously, a paper web draw-in apparatus is used to feed the leading end of a paper web through the press. This web draw-in apparatus typically uses a roller chain that carries web grippers, and a guide strip or rail for the chain to run in. As may be seen most clearly in FIG. 8 a fixed profiled strip 59, which may be provided with a C-shaped cross-sectional profile, receives a finite lengthed paper web draw-in device, such as a roller chain 62 that is used to draw in the paper web 6, as disclosed in German Patent Publication DE 42 02 713 C2. This fixed profile strip 59 is secured to the side frame 2 or 46 by suitable support holders that are not specifically shown and is located adjacent the cylinders 3 and 4 and after the slit shaft 21 in the direction of web travel. As is shown in FIGS. 3 and 9, one end of the slit shaft 21, which may be the end of shaft 21 adjacent the right journal 57, has a widening or an opening 61 of its slit end. This widening or opening 61 in the slit 22 has a profile that is the same as the profile of the fixed profile strip 59. This opening 61 will thus allow the roller chain 62 that is carried by the fixed profile strip 59 to pass through the slit shaft 21 during feeding of the leading end of a paper web 6 through the printing pres. It will be understood that once feeding of the web has been accomplished, the roller chain will be removed from the opening 61 in the slit shaft 21.

Figure 8:
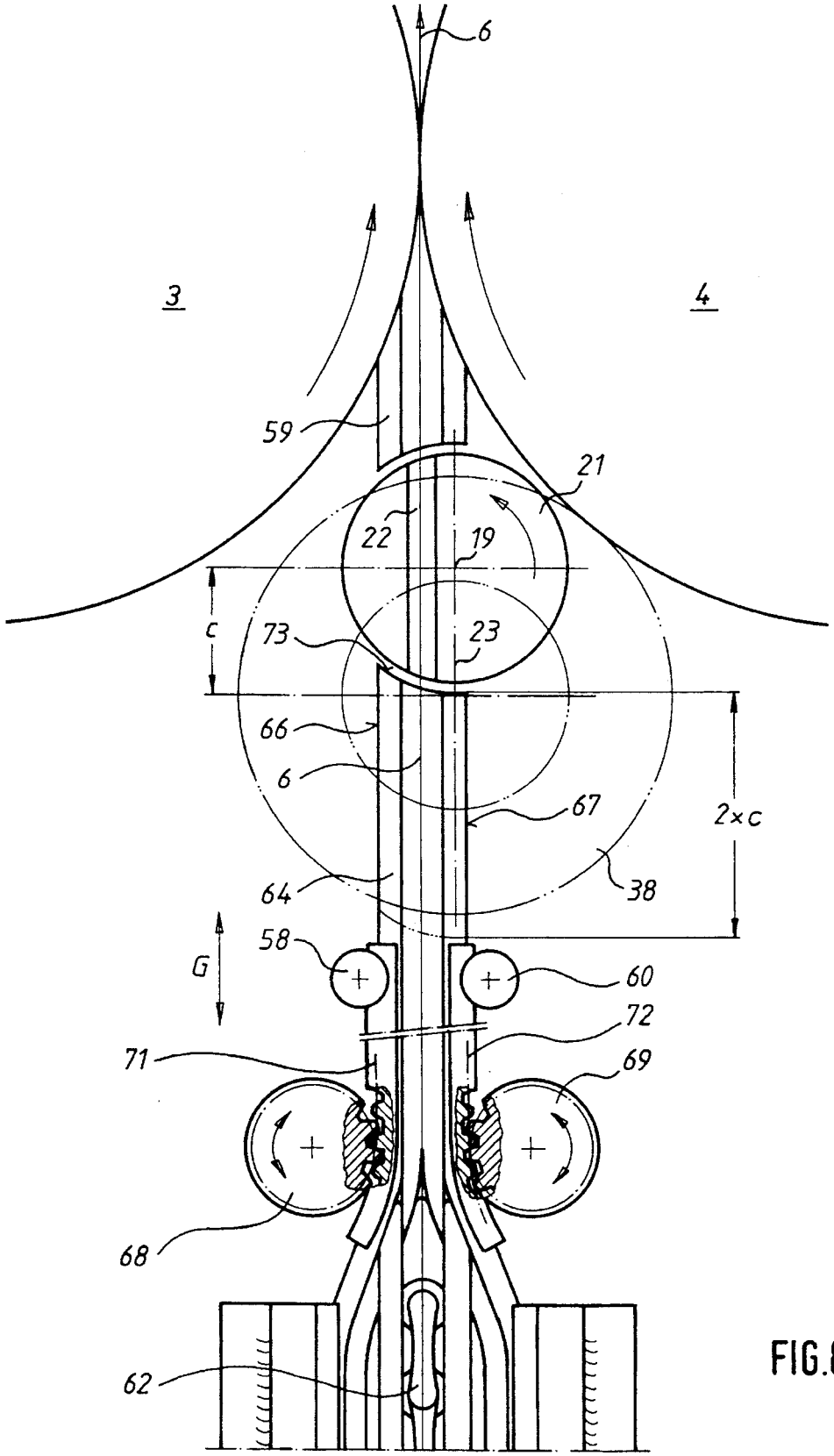
FIG. 8 is a sectional view of the present invention, taken along line VIII—VIII of FIG. 3 and showing the operation of the profiled guide strip of the paper lead-in device.
Figure 9:
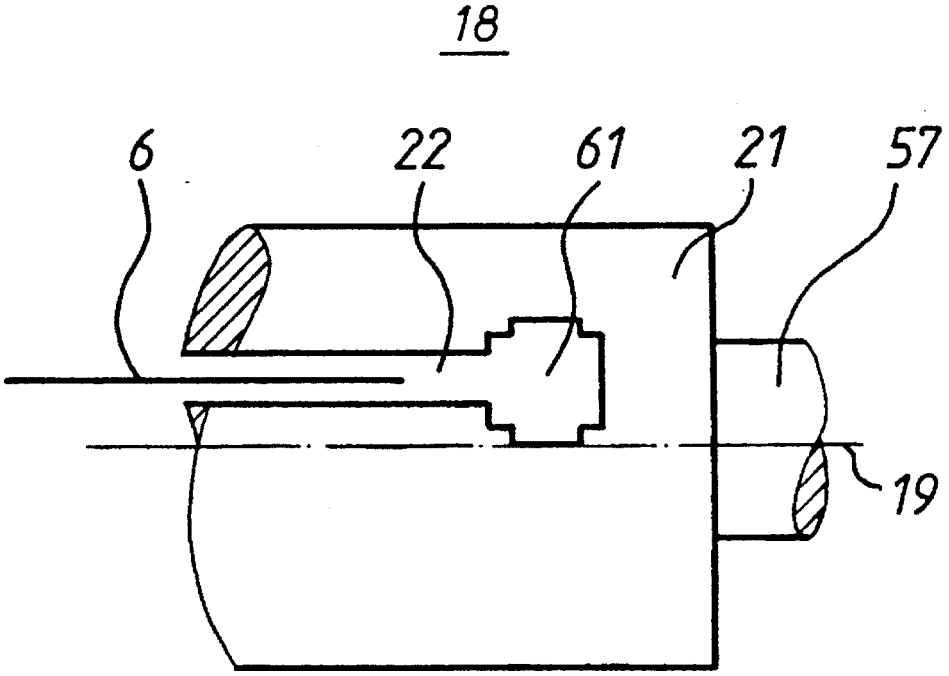
FIG. 9 is a view of a portion of the slit shaft taken in the direction indicated by the arrow F in FIG. 3.

A retractable profiled strip 64, that has a profile shape the same as the fixed profile strip 59, is situated below the slit shaft 21, as seen in FIG. 8. This retractable profiled strip 64 is shiftable in the vertical direction G, as indicated in FIG. 8 and is aligned with a center line 63 of the fixed profile strip 59 as well as with the C-shaped widening or opening 61 in the slit 22 of the shaft 21. This retractable profiled strip 64 is displaceably secured to the side frame 46 and is guided by guide bolts 58 and 60 that engage the two long sides 66 and 67 of the retractable profiled strip 64. A pair of motor driven gear wheels 68 and 69 engage toothed profiles on the long sides 66 and 67 of the retractable profiled strip 64. These toothed profiles are embodied as toothed racks 71 and 72 and are formed along partial lengths of the long sides 66 and 67 of the retractable profiled strip 64. The length of these toothed rack profiles 71 and 72 is generally twice the distance "c" with that distance being the amount of travel of the slit shaft 21, as shown in FIG. 1. The retraction distance of 2×"c" for the retractable profiled strip 64 will be sufficient to retract the free end of the retractable strip 64 out of possible engagement with the paper web 38 accumulated on the slit shaft 21. The amount "c" typically corresponds to the radius of the slit shaft 21. However the amount "c" could be made larger depending on various factors, such as the thickness of the paper web 6, the printing press production speed, the stopping time of the press, or the diameter of the shaft 21. The motors which are used to turn the gear wheels 68 and 69 are not specifically depicted in FIG. 8. These motors can be electric motors and would receive a signal to retract the retractable profiled strip 64 into its retracted position remote from the slit shaft 21 at the same time the gear motor 34 for the shaft 21 would receive its signal. The free end 73 of the retractable profiled strip 64 is shaped to be similar to the profile of the slit shaft 21. This profiled free end 73 of the retractable profile strip 64 is depicted in dot-dash lines in FIG. 8 after it has been retracted down away from the slit shaft 21 by the distance 2×"c". The retractable profiled strip 64 could also be guided by linear guides instead of by the guide bolts 58 and 60. The shifting of the retractable profiled strip 64 could also be accomplished by operation of a pneumatic working cylinder secured to the side frame. The contraction of a profiled guide strip, such as is used for the guide strip 64, is described in detail in the German Patent Publication DE 42 02 713 C2 and particularly in FIG. 4 of that document.

It would also be possible to move the profiled guide strip 64 out of the way of the growing strip shaft 21 and its accumulating paper web 38 by the distance of 2×"c" in other ways. A portion of the displaceable profile strip 64 could be shifted in a direction parallel to the paper web 6. Alternatively, the displaceable guide strip 64 could be provided with a portion that would be pivotable about a bearing pivotably fixed to the side frame 46 of the press. A drive element for this could consist of pneumatically operated working cylinders. In each of these embodiments, the displaceable profiled guide strip 64 is shiftable or movable out of the area which will be taken up as the slit shaft 21 grows in size and shifts its location in response to the build up of paper web 38 on the slit shaft 21.

While a preferred embodiment of a paper web cutting device in accordance with the present invention has been set forth fully and completely hereinabove, it will be apparent to one of skill in the art that a number of changes in, for example, the sizes of the printing cylinders, the types of printing press, the drives for the printing cylinders and the like could be made without departing from the true spirit and scope of the present invention which is accordingly to be limited only by the following claims.

What is claimed is:

1. A paper web cutting device for the transverse cutting of a paper web in a web-fed rotary printing press comprising:

first and second cooperating cylinders supported for rotation between spaced side frames and defining a paper web inlet wedge area;

a slit shaft positioned in said inlet wedge area before, in a direction of paper web travel, said first and second cooperating cylinders, said slit shaft having a slit sized to allow passage of a paper web through said shaft;

means for rotating said slit shaft to transversely cut a paper web passing through said slit and to wind a paper web on said slit shaft; and means for supporting said slit shaft between said side frames and for allowing said slit shaft to move out of said inlet wedge area in a direction opposite to said direction of paper web travel in response to accumulation of a paper web wound on said slit shaft.

2. The paper web cutting device of claim 1 further including a paper web draw-in device usable to feed a paper web through said slit shaft and between said first and second cooperating cylinders, said slit in said slit shaft having an opening at a first ends said slit shaft end opening being sized to allow passage of said draw-in device through said slit shaft.

3. The paper web cutting device of claim 1 wherein said slit has at least a first trailing edge which is a paper web cutting edge.

4. The paper web cutting device of claim 1 wherein said slit shaft has a circular cross-section.

5. The paper web cutting device of claim 1 wherein said slit shaft is hollow and has a rectangular cross-section.

6. The paper web cutting device of claim 3 wherein said paper web cutting edge is rounded and is coated with a high frictional resistance substance.

7. The paper web cutting device of claim 1 wherein said slit shaft has shaft journals, and further wherein said means for supporting said slit shaft includes bearing support plates slidably secured to said spaced side frames and receiving said shaft journals.

8. The paper web cutting device of claim 2 wherein said draw-in device is a roller chain.

9. The paper web cutting device of claim 3 wherein said cutting edge is a serrated cutter.

10. The paper web cutting device of claim 4 wherein said slit shaft is hollow.

11. The paper web cutting device of claim 1 wherein said slit is centered on an axis of rotation of said shaft.

12. The paper web cutting device of claim 1 wherein said slit is off-centered with respect to an axis of rotation of said shaft.

13. The paper web cutting device of claim 7 wherein each of said bearing support plates is provided with elongated slots which receive bolts secured to said side frames.

14. The paper web cutting device of claim 13 further including springs attached to said side frames and said bearing support plates and biasing said bearing support plates toward said inlet wedge.

* * * * *